United States Patent [19]

Aubert

[11] 4,352,592

[45] Oct. 5, 1982

[54] GATE SYSTEM FOR A HYDRAULIC DAM

[76] Inventor: Jean Aubert, 8, rue La Boétie, 75008 Paris, France

[21] Appl. No.: 156,390

[22] Filed: Jun. 4, 1980

[30] Foreign Application Priority Data

Jun. 12, 1979 [FR] France ..... 79 14986

[51] Int. Cl.[3] ..... E02B 7/40

[52] U.S. Cl. ..... 405/102; 405/101

[58] Field of Search ..... 405/87, 90, 100, 101, 405/102; 49/340

[56] References Cited

U.S. PATENT DOCUMENTS

| | | | |
|---|---|---|---|
| 2,335,327 | 11/1943 | Wellons | 405/102 |
| 3,718,002 | 2/1973 | Aubert | 405/102 |
| 3,775,983 | 12/1973 | Aubert | 405/102 |
| 4,073,147 | 2/1978 | Nomura | 405/101 X |

*Primary Examiner*—David H. Corbin

*Attorney, Agent, or Firm*—Young & Thompson

[57] ABSTRACT

The gate system comprises a wicket which is capable of taking up a number of different positions corresponding to predetermined angles of inclination, an operating device comprising a pivotally mounted jack, and a rotatable abutment member carried by the wicket for receiving the end of the operating rod of the jack. The jack is restored to an end position of angular orientation when the operating rod is moved away from the abutment member. This end orientation is close to the orientations of the jack during operation. The operating rod of the jack and the abutment member comprise guiding apparatus for orienting the jack towards the abutment member when the end of the jack-operating rod comes close to the abutment member.

23 Claims, 7 Drawing Figures

GATE SYSTEM FOR A HYDRAULIC DAM

This invention relates to a movable gate system comprising a wicket and downstream jack for a hydraulic dam.

Said movable gate is mounted between two abutments which are constructed along river banks at the ends of the floor of a movable dam or on the spillway crest of a gravity dam.

Some gate systems which are already known consist of juxtaposed elements of small size which can be displaced independently of each other. These elements each comprise a wicket which is capable of taking up a practically vertical end position, a second and substantially horizontal end position and which, in many instances, is also capable of taking up intermediate positions.

Movable gate elements of this type can comprise a wicket panel pivotally mounted on the floor or body of the dam and maintained in the different positions mentioned above by means of a prop supported on stop catches which are secured to the floor or body of the dam.

In another known design, the movable gate elements comprise a tie-frame or horse which is pivoted to the floor or body of the dam and a wicket panel which is in turn pivoted about a horizontal shaft or hinge-pin attached to the horse. In that case, the prop is pivoted to the horse. During normal operations, the wicket panel and the horse remain applied against each other but the degree of additional freedom introduced by interposition of the horse between the wicket panel and the floor of the dam is an advantage in the event of impact.

In the following description, the term "wicket" refers not only to the wicket panel but also to the other movable components which are associated therewith. The term applies both to the wicket panel which is pivotally mounted directly on the floor and to the panel which is pivoted to a hinged horse or to other juxtaposed and differently arranged elements having small dimensions.

A gate system of this type as contemplated in the present invention is described in French Pat. No. 2,148,836.

In this patent, the movable gate system for a hydraulic dam is provided with an operating device comprising an oscillating jack rotatably mounted with respect to a horizontal shaft attached to the floor or body of the dam and an abutment member which is orientable about a horizontal shaft attached to the wicket, said abutment member being adapted to receive the extremity of the rod of the jack during an operation of said wicket.

In accordance with this patent, arrangements are made to ensure that, between two operations, the rod of the jack is withdrawn into the interior of the jack body in which said rod is immersed in oil. The operating rod of the jack is thus protected against the action of the water except during the operations of the wicket which are of short duration. Said action of the water would be liable to result in oxidation of the jack-operating rod if the water were acid and in erosion if the water contained substances in suspension.

In accordance with French Pat. No. 2,148,836, the system further comprises a device for locking the main jack body in position between two operations. This device is controlled in dependence on the supply of oil under high pressure to the jack, with the result that the locking action is suppressed automatically at the beginning of each operation.

The system further comprises a device for locking the abutment member of the wicket between two operations.

Between two operations, the jack body on the one hand and the abutment member of the wicket on the other hand accordingly retain the position which they had occupied at the end of a previous operation. At the beginning of another operation, the rod of the jack will therefore be oriented towards the abutment member which will in turn be suitably positioned for receiving said rod. This locking system would possibly operate in a satisfactory manner but would nevertheless prove fairly costly and relatively complex, thereby reducing the reliability of the system.

The aim of this invention is to overcome this drawback by providing a gate system with wicket and downstream jack in which the operating rod of the jack is withdrawn into the jack body between two operations and which is both simple, reliable and economical.

The gate system contemplated by the invention comprises at least one wicket which can be set at a number of predetermined angles of inclination about a horizontal shaft which is attached to the floor or body of the dam. Each wicket is provided with an operating device comprising on the one hand a jack pivotally mounted on the floor or body of the dam downstream of the wicket and, on the other hand, with an abutment member rotatably mounted on a horizontal shaft carried by the wicket panel or by the horse, said abutment member being intended to receive the free end of the operating rod of the jack. Means are provided for ensuring that the operating rod of the jack is fully withdrawn into the jack body between two operations of the wicket.

In accordance with the invention, said gate system is distinguished by the fact that the jack is associated with restoring means for moving said jack to an end position of angular orientation about its axis of pivotal motion when the operating rod of the jack is moved away from the abutment member. This end position of angular orientation designated as extreme orientation is close to the orientations assumed by the jack when the operating rod of this latter is in contact with the abutment member in the different predetermined positions of inclination of the wicket. The free end of the jack-operating rod and the abutment member are provided with guiding means for ensuring positive engagement of the end of the jack-operating rod and of the abutment member when these components come into contact with each other.

Thus the fairly complex device for locking the jack body in position between two operations as described in French Pat. No. 2,148,836 is no longer necessary. After each operation of the wicket, and as soon as the operating rod of the jack moves away from the abutment member and withdraws into the jack body, the restoring means of the system in accordance with the invention place the jack in its extreme orientation. At the beginning of the following operation, the rod consequently moves out of the jack body in the aforesaid extreme orientation. When the end of the operating rod is applied against the abutment member of the wicket, the guiding means automatically bring the end of the operating rod into coincident relation with the abutment member.

In accordance with a particular feature of the invention, the guiding means aforesaid comprise a spherical zone of the abutment member which is traversed by said horizontal shaft carried by the wicket, and a cup fixed on the free end of the jack-operating rod for receiving said spherical zone.

Since the abutment member is provided with a spherical zone, its orientation is unimportant and there is no need to provide a device for locking said abutment member between two operations of the wicket.

The arrangement mentioned above therefore provides a further simplification in comparison with the prior art.

In an advantageous embodiment of the invention, the dimensions of the cup are such that, in each of the aforesaid predetermined positions of the wicket, the center of the spherical zone of the abutment member is located within the interior of the cylinder swept by the cup when the jack is disposed in the end orientation aforesaid.

In consequence, the cup is capable of engaging with the spherical zone of the abutment member irrespective of the predetermined position of the wicket.

In a preferred embodiment of the invention, the gate system further comprises a small-scale wicket installed within the visual range of an operator and means for imparting to said small-scale wicket a movement which is similar to that of one of the wickets of the gate.

This embodiment of the invention enables an operator to determine the position of the gate wicket simply by observing the small-scale wicket.

Further distinctive features and advantages of the invention will be more apparent upon consideration of the following detailed description, reference being made to the accompanying drawings in which a number of embodiments of the invention are illustrated by way of example and not in any limiting cause, and in which.

Figure 1:
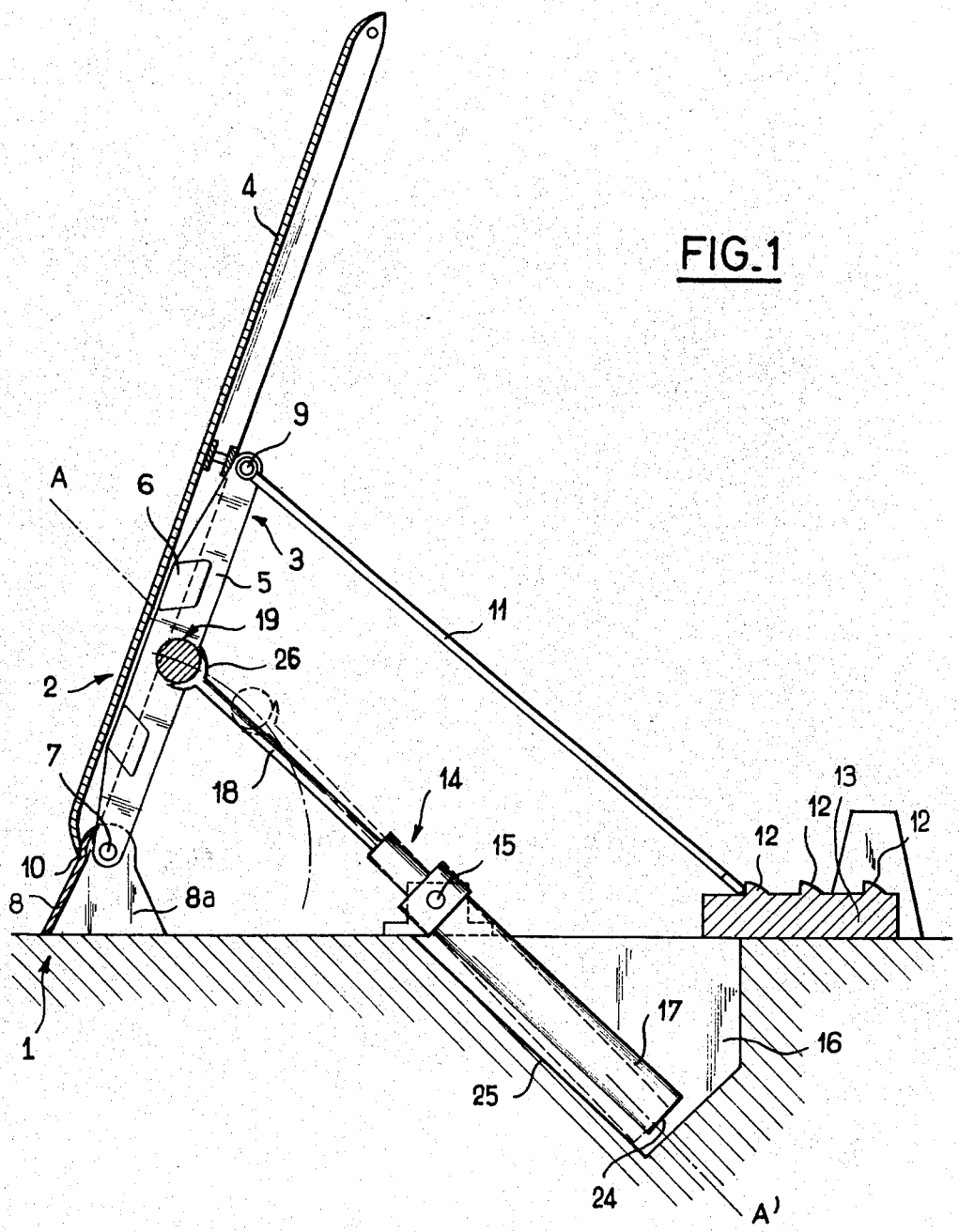
FIG. 1 is a transverse sectional view of a movable gate element in accordance with the invention, the wicket being in the raised position.

Referring to FIG. 1, the gate system mounted on the floor 1 or body of a dam comprises a wicket 2 provided with a horse 3 and a wicket panel 4. The horse 3 is made up of two parallel side-stringers 5 joined together by two cross-members 6. The wicket 2 is pivotally mounted on the floor 1 or body of the dam at one end of each side-stringer 5 of the horse 3 by means of a horizontal shaft 7 carried by two support brackets 8*a* associated with a sill 8 which extends over the full length of the gate and is embedded in the floor or body of the dam.

The wicket panel 4 is pivotally attached to the other ends of the side-stringers 5 of the horse by means of a shaft 9 which is parallel to the horizontal shaft 7. Said wicket panel 4 is substantially rectangular and the shaft 9 is disposed substantially on a center-line of said wicket panel. In the service position, the horizontal bottom edge 10 of the wicket panel 4 rests on the sill 8.

A prop 11 is pivoted to the wicket 2 by means of the shaft 9. The lower end or foot of said prop 11 is supported in one of the stop-catches 12 of a slide 13. Depending on whether the foot of the prop 11 is applied against one stop-catch 12 or another, the wicket 2 takes up a corresponding position of predetermined inclination designated in FIG. 4 by positions P1, P2, P3.

As shown in FIG. 1, a jack 14 is pivotally mounted with respect to the dam body 1 by means of a pivot-pin 15 located downstream with respect to the wicket 2. A cavity 16 is formed in the floor 1 of the dam in order to provide a housing for the body 17 of the jack 14.

Said jack housing is protected by a cover (not shown in the figures) against deposition of solid products which would eventually be liable to limit or prevent movements of the jack within its housing.

Hydraulic control means described hereinafter serve to actuate the jack 14 in order to cause outward extension or inward withdrawal of the operating rod of said jack.

Substantially at equal distance between the horizontal shaft 7 and the shaft 9, the horse 3 of the wicket 2 is adapted to carry an abutment member 19 for receiving the free end of the operating rod 18 of the jack 14.

Figure 3:
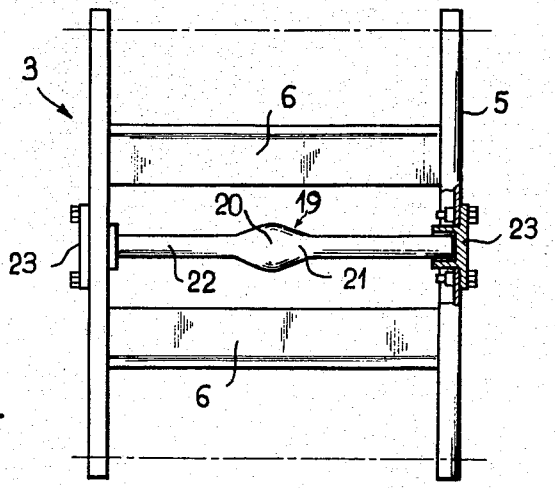
FIG. 3 is a view in elevation of the horse fitted with the abutment member of the wicket.

In accordance with the invention, the abutment member 19 is provided with guiding means for ensuring free and positive engagement of said abutment member with the end of the operating rod 18 of the jack 14 when this latter comes into contact with said abutment member 19. As shown in FIG. 3, said guiding means comprise a spherical zone 20 connected by means of two frusto-conical reinforcements 21 to a shaft 22 which passes through the center of said zone. The shaft 22 is parallel to the horizontal shaft 7 and to the shaft 9. Each end of the shaft 22 is mounted to rotate freely in a pivot-bearing 23 which is secured respectively to each side-stringer 5 of the horse 3.

Reference being made to FIG. 1, the jack 14 is associated with restoring means comprising a positioning of the pivot-pin 15 of the jack 14 in such a manner as to ensure that the center of gravity of said jack is always located at a point remote from the free end of the operating rod 18 relative to said pivot-pin 15, even when said rod 18 is in the fully extended position.

Thus the jack 14 continuously tends to return to an end position of angular orientation designated as an extreme orientation and having a direction A–A′ in which the base 24 of the jack body 17 is applied against one wall 25 of the jack housing 16.

Figure 4:
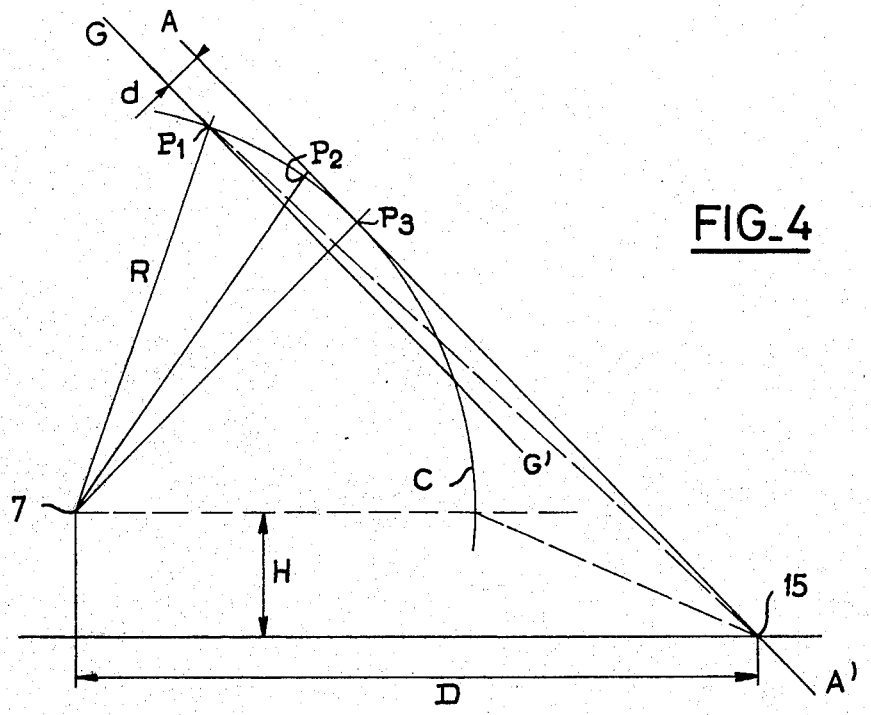
FIG. 4 is a diagram showing the arrangement of the jack and of the wicket in the different inclined positions of the wicket.

The aforesaid extreme orientation having a direction A–A′ is close to the orientations assumed by the jack 14 in each of the positions P1, P2, P3 of the wicket (as shown in FIG. 4).

In the example illustrated, the distinctive feature results from the fact that the pivot-pin 15 of the jack 14 encounters the tangent at 45°, with respect to the horizontal, of a circle C on which displacement of the center of the spherical zone 20 of the abutment member 19 takes place during a movement of the wicket 2. Furthermore, the point of application of the base 24 of the jack body 17 against the wall 25 of the jack housing 16 is located in such a manner as to ensure that the direction A–A′ of orientation of the jack is constituted substantially by the tangent to the circle C.

Arrangements have also been made to ensure that the extreme orientation of the jack 14 corresponds to the orientation assumed by this latter when its operating rod 18 is in contact with the abutment member 19 in position P3 corresponding to one of the different possible positions of the wicket 2.

In fact, in the example shown in the drawings, positions P1, P2, P3 correspond to a predetermined angle of inclination of the wicket 2 with respect to the vertical, namely an angle which is respectively equal to 20°, 35° and 45° approximately.

Thus, when the wicket takes up its position P3, the center of the spherical zone 20 of the abutment member 19 is located at a point at which the direction A–A′ is tangent to the circle C. From this it accordingly follows that, in this position P3 of the wicket 2, the axis of the operating rod 18, when carrying out a movement of outward extension from the body 17 of the jack 14, encounters the center of the spherical abutment member 19. The interengagement of the two components is therefore perfect as soon as these latter come into contact with each other.

In position P2 of the wicket 2 which corresponds to an angle of inclination of 35° with respect to the vertical, it is apparent that the orientation of the jack 14, when the free end of the operating rod 18 is applied against the abutment member 19, is very close to the extreme orientation of said jack 14.

In position P1 of the wicket 2 which corresponds to an angle of inclination of 20° with respect to the vertical, the angle between on the one hand the jack 14 when the free end of its operating rod 18 is in a stable position of application against the abutment member 19 and, on the other hand, the direction A—A′ of the extreme orientation of said jack 14 remains of small value. In consequence, the distance d (FIGS. 4 and 5) from the center of the spherical zone 20 to the direction A—A′ when the wicket 2 is in position P1 is also of small value.

The following notations will now be adopted: D will designate the distance, projected on a horizontal plane, between the horizontal shaft 7 and the pivot-pin 15; H will designate the same distance projected on a vertical plane; R will designate the distance between the horizontal shaft 7 and the shaft 22; R is consequently the radius of the circle C.

In practice, the following numerical values can be adopted if the gate is of small height:

D=1200 millimeters

H=250 millimeters

R=600 millimeters

From these data, it follows that:

d=64 millimeters approx.

If the geometry described in the foregoing is therefore adopted for the arrangement of the wicket 2 and of the jack 14, there is in fact obtained a distance d which is of small value when compared with the overall size of the device.

Figure 5:
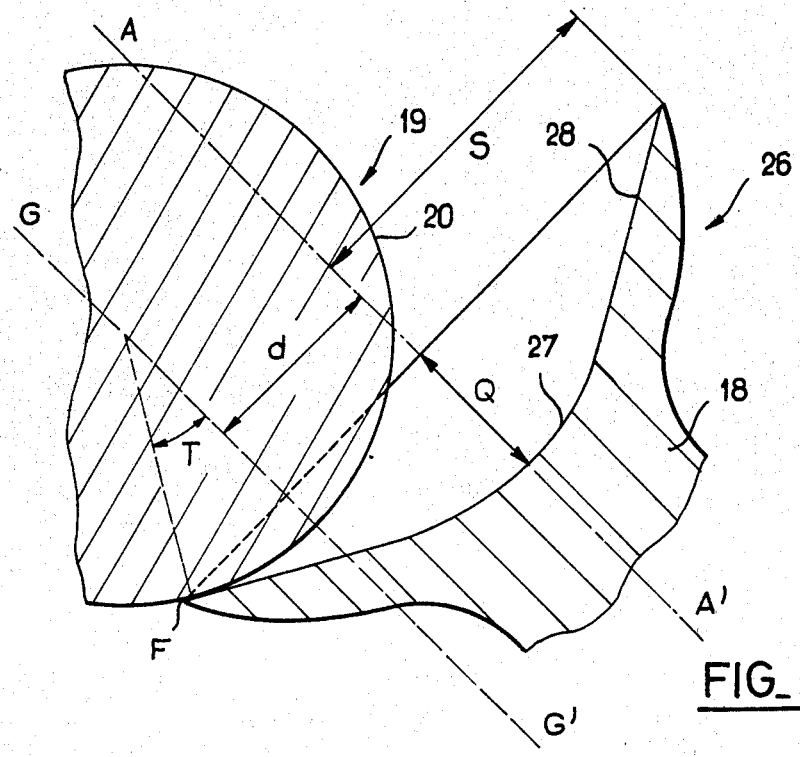
FIG. 5 is a fragmentary sectional view of the abutment member and of the cup at right angles to the axis of said abutment member, the cup being shown in this view at the moment when it comes into contact with the abutment member whilst the wicket is in its uppermost position of predetermined inclination.

As shown in FIG. 5, the free end of the operating rod 18 of the jack 14 comprises (as in the case of the abutment member 19) guiding means for ensuring positive engagement of said free end of the operating rod 18 on the spherical zone 20 when these members come into contact with each other.

The guiding means aforesaid comprise a cup 26 fixed on the end of the operating rod 18. Said cup 26 has a spherical bottom portion 27 which preferably has the same diameter as the spherical zone 20 of the abutment member 19, said spherical bottom portion being provided around its entire periphery with an extension in the form of a frusto-conical edge portion 28 which is substantially tangent to said spherical bottom portion 27.

The radius S of the large base of the frusto-conical edge portion 28 is chosen so as to ensure that, in each position P1, P2, P3, the center of the spherical zone 20 is located within the interior of the cylinder swept by the cup 26 when the operating rod 18 undergoes a displacement with respect to the body 17 of the jack 14 in the extreme orientation. In other words, in the case of the example shown in the figure, the center of the spherical zone 20 is located within the interior of a cylinder having a radius S and an axis A–A′ in each of the positions P1, P2, P3 of the wicket 2.

This result is achieved by adopting for the large base of the frusto-conical edge portion 28 of the cup 26 a radius S which is longer than the distance d.

Preferably, the radius S is longer than d by a distance substantially equal to one-half of the radius of the spherical zone 20.

The depth Q of the cup 26 is smaller than the difference between the radius of the spherical zone 20 and the radius of the shaft 22 of the abutment member 19.

Figure 2:
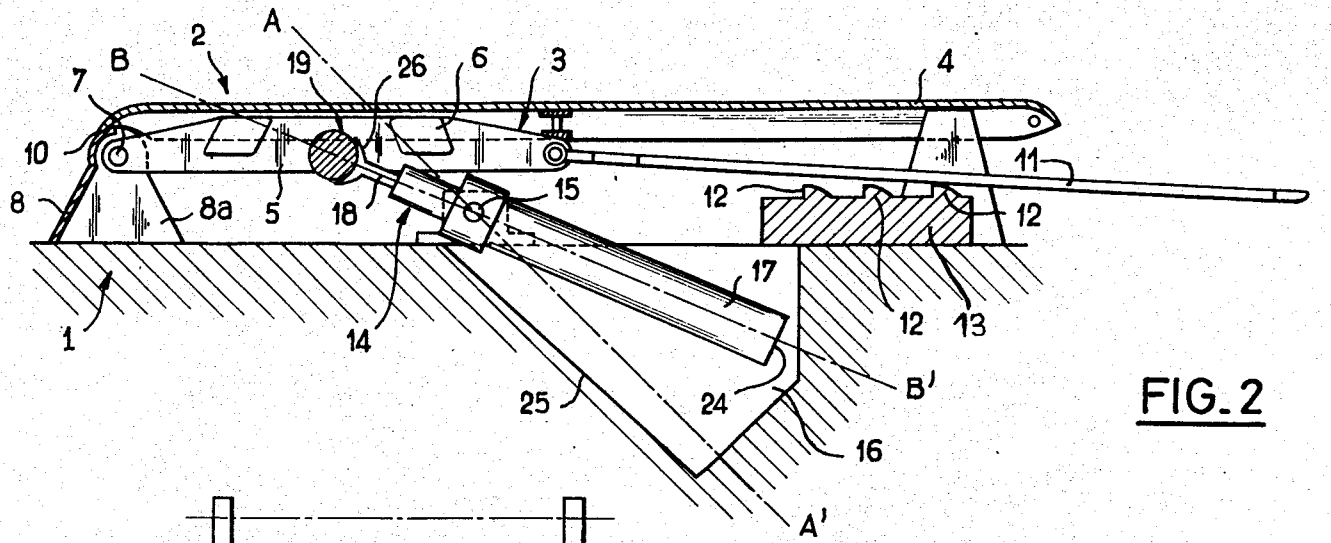
FIG. 2 is a view which is similar to FIG. 1, the wicket being in the horizontal or flat position.

FIG. 2 shows the panel 4 of the wicket 2 after this latter has been lowered to a flat position in the vicinity of the horizontal. In this position, the jack 14 is maintained in a direction B–B′ by the weight of the wicket 2 which is applied at the level of the abutment member 19 on the cup 26 which is not liable to become disengaged from said abutment member 19 since the operating rod 18 is in the fully withdrawn position.

This position is stable by reason of the fact that the weight of the wicket 2 is sufficient to ensure that the moment applied at the level of the abutment member 19 with respect to the axis of the pivot-pin 15 is of higher value than the moment applied by the weight of the jack 14 with respect to the same axis.

The operation of the gate system in accordance with the invention is as follows:

It will first be assumed that the wicket takes up one of its positions P1, P2, P3 and that the operating rod 18 of the jack 14 is withdrawn with the jack body 17.

Under the action of its own weight, the jack 14 is applied against the wall 25 of the housing 16 and is therefore oriented in the direction A–A′.

In order to change the position of the wicket 2, the jack 14 is controlled in known manner so as to produce outward displacement of the operating rod 18 from the jack body 17. During this movement, the jack 14 retains its extreme orientation until the cup 26 encounters the spherical zone 20 of the abutment member 19.

Since the radius S (as shown in FIG. 5) is longer than the distance d irrespective of the predetermined position P1, P2, P3 occupied by the wicket 2, this encounter will accordingly take place.

In addition, since said radius S is greater than the distance d by approximately one-half of the radius of the spherical zone 20 even in position P1 which is the most unfavorable for an encounter, not only will this encounter certainly take place but, in addition, the edge of the cup 26 will come into contact with the spherical zone 20 beyond its polar axis G–G′ parallel to the direction A–A′ at a point F. The associated radius of the spherical zone 20 makes an angle T of at least 30° with said polar axis G–G′.

During the remainder of the movement of extension of the operating rod 18, the shaft 22 of the spherical zone 20 carries out a movement of pivotal displacement within its pivot-bearings 23 and the spherical zone 20 rolls within the spherical bottom portion 27 of the cup 26 whilst the jack 14 moves away from its extreme orientation and is progressively oriented in the direction of the center of the spherical zone 20. Since provision is made for a sufficiently large angle T, the movements of the two components will combine in the manner which has just been indicated in spite of inevitable friction within the pivot-bearings 23, in spite of friction around the pivot-pin 15 and in spite of the preponderant weight of the body 17 of the jack 14.

As has in any case been confirmed by experiments performed on a model, the reasoning given above shows that these relative displacements take place even if the angle T is of relatively small value. It is apparent from FIG. 5 that there would be a change of sign of the angle T only if the distance d were to become larger than the radius S of the cup.

By virtue of the spherical symmetry of the bearing portions of the abutment member 19 and of the extremity of the operating rod 18, namely the spherical zone 20 and the cup 26, in the event that the operating rod 18 of the jack 14 were to rotate on its longitudinal axis during an operation, this would not be detrimental to correct application of the cup 26 against the spherical zone 20. Such a rotational displacement of a jack-operating rod is in any case a frequent occurrence.

The remainder of the operation takes place in known manner until the wicket 2 is installed in its new position of predetermined inclination P1, P2, P3.

Withdrawal of the operating rod 18 is then controlled in the known manner. As the cup 26 moves away from the abutment member 19, so the jack 14 progressively returns to its extreme orientation under the action of its weight. The operating rod 18 withdraws until it takes up its fully retracted position.

Before describing the operation to be performed in order to lower the wicket 2 from one of the positions P1, P2 or P3 until it is laid flat on the floor of the dam, it will first be useful to recall the essential arrangements of the slide. The lower end of the wicket prop is guided in all its displacements by means of a slide, the shapes of which have the distinguishing features described below.

If the wicket is lifted to a slight extent from the position P3, it is then only necessary to lower the wicket to the flat position by means of an oil-discharge system. Starting from position P2, the wicket cannot be laid flat directly and it is first necessary in this case to reach and pass beyond the position P1. From position P1, a slight displacement in the upstream direction followed by a downward movement brings the wicket to position P3 by means of a further discharge. Starting from the last position just mentioned, the wicket can be laid flat as stated earlier. The detailed procedure involved in the operations to be performed in order to pass from one position to another can be deduced from the foregoing.

In order to lower the wicket to the flat position from the position P3, the operating rod 18 is actuated so as to cause said rod to lift the wicket 2 as explained in the foregoing. The wicket is then brought to a position which is slightly nearer to the vertical than the position P3. By reason of the shape of the slide 13, it is then only necessary to permit full withdrawal of the operating rod 18 of the jack 14, the pressure applied on the cup 26 by the spherical zone 19 being maintained until the end of this operation. On completion of said operation, the wicket panel is horizontal, the operating rod of the jack 14 is at the inner end of travel and the spherical zone 20 remains engaged within the cup 26.

In order to return said wicket 2 from its flat position to one of the positions P1, P2, P3, said wicket is lifted by means of the jack 14 until it passes very slightly beyond one of the positions P1, P2 or P3. The direction of displacement of the operating rod 18 is then reversed in order to withdraw this latter completely within the body 17 of the jack 14. At the beginning of this downward movement, the spherical zone 20 applies a pressure on the cup 26 but this pressure is suddenly discontinued as soon as the foot of the prop 11 is applied against one of the stop-catches 12 of the slide 13.

In comparison with the present state of technical development, it is thus wholly evident that the present invention introduces a considerable simplification in movable gate systems comprising wickets and downstream jacks as employed in the prior art while retaining all the advantages of these latter.

The prior art system could operate only if it proved feasible to prevent any failure of one of the two methods of locking which were adopted. The system in accordance with the invention is less costly and, above all, is much more reliable.

Figure 6:
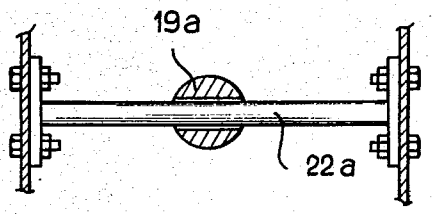
FIG. 6 is a fragmentary view in elevation showing an alternative form of construction of the abutment member.

As shown in FIG. 6 and in an alternative form of construction of the abutment system, the horse 3 is no longer provided with a shaft 22 but is adapted to carry a stationary shaft **22*a* on which a sphere 19*a*** is rotatably mounted.

By virtue of this second arrangement, the diameter which can be adopted for the shaft **22*a* is smaller than the diameter of the end portions of the shaft 22**. This reduction in diameter facilitates rotational motion of the sphere.

In the system just mentioned as in the case of the system comprising the rotating shaft 22, a first relative positional adaptation takes place when the two components move towards each other: the sphere **19*a* or the shaft 22 rotate whilst the cup (together with the operating rod of the jack) undergoes a displacement so that the axis of this latter encounters respectively the shaft 22*a* or 22**.

However, in the system in which provision is made for a stationary shaft **22*a* and only in this case, a second modification of relative positions takes place if the sphere 19*a* has experienced a slight displacement on its shaft 22*a* and the center of said sphere is no longer located strictly in the vertical plane of symmetry swept by the axis of the jack-operating rod 18. As has been verified in an experimental model, the cup 26 accordingly produces lateral action on the sphere 19*a* which is thus caused to slide on the shaft 22*a* and returned in the plane of symmetry. In this case, it is the cup 26 which produces a displacement of the sphere 19*a*** and not the reverse.

These changes of position take place prior to interengagement of the two members, with the result that the applied stresses remain low in value.

It is an entirely different matter when interengagement has been completed. From this time onward, and no matter which of the two forms of construction may have been adopted for the abutment system, the two components are virtually bonded to each other in the sense that they are no longer capable of undergoing any relative displacement during the remainder of the operation.

A comparison will serve to gain a clearer understanding of the nature of the mutual relationship of the two components. When they are thus interengaged, the assembly is comparable with a connecting-rod, the big end of which is constituted by the sphere 19, 19*a* and the body of which is constituted by the operating rod 18 of the jack.

The distinctive feature of this connecting-rod lies in the fact that it is capable of forming two separate parts when there are no efforts to be transmitted so that the connecting-rod body may momentarily move to a position within the cylinder of the jack 14 in which it is protected against rust formation.

After a separation, the two components return towards each other and undergo relative displacements so as to be rigidly coupled together.

The procedure to be adopted in order to move a wicket from one position to another as already mentioned always involves outward extension of the jack-operating rod followed by subsequent withdrawal.

In order to control these displacements of the jack-operating rod, it has been mentioned earlier that the operation was carried out in a known manner. However, provision is made for a novel device within the scope of the present invention.

This device enables the operator to follow in detail the complex displacements of the foot of the prop within the slide. In the improbable event of a fault condition occurring during an operation, the operator would accordingly be permitted to detect the cause of the condition without difficulty. On the contrary, if it were considered sufficient to place at his disposal push-buttons for controlling the different operations, he would not be able to determine in a simple manner the origin of a disturbance.

It is difficult for an operator to ensure direct observation of displacements which take place on the floor of a dam and below the level of the downstream pool. However, he can be given a schematic vision of such displacements as will be explained hereinafter.

To this end, there is placed in the operating cabin a dam element having small dimensions and steps are taken to ensure that this element undergoes displacements while remaining continuously in a position similar to the position occupied by that element of the dam whose displacement is being controlled.

Figure 7:
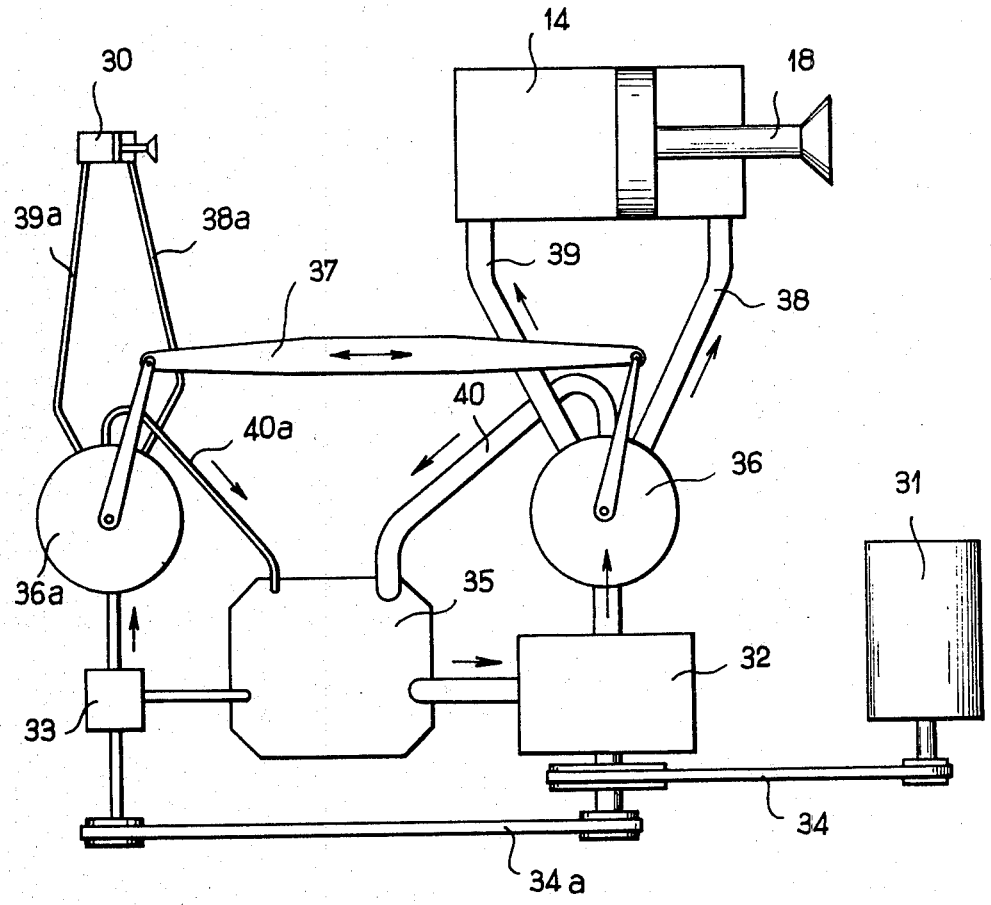
FIG. 7 is a diagrammatic view of the hydraulic control system.
Figure 7:
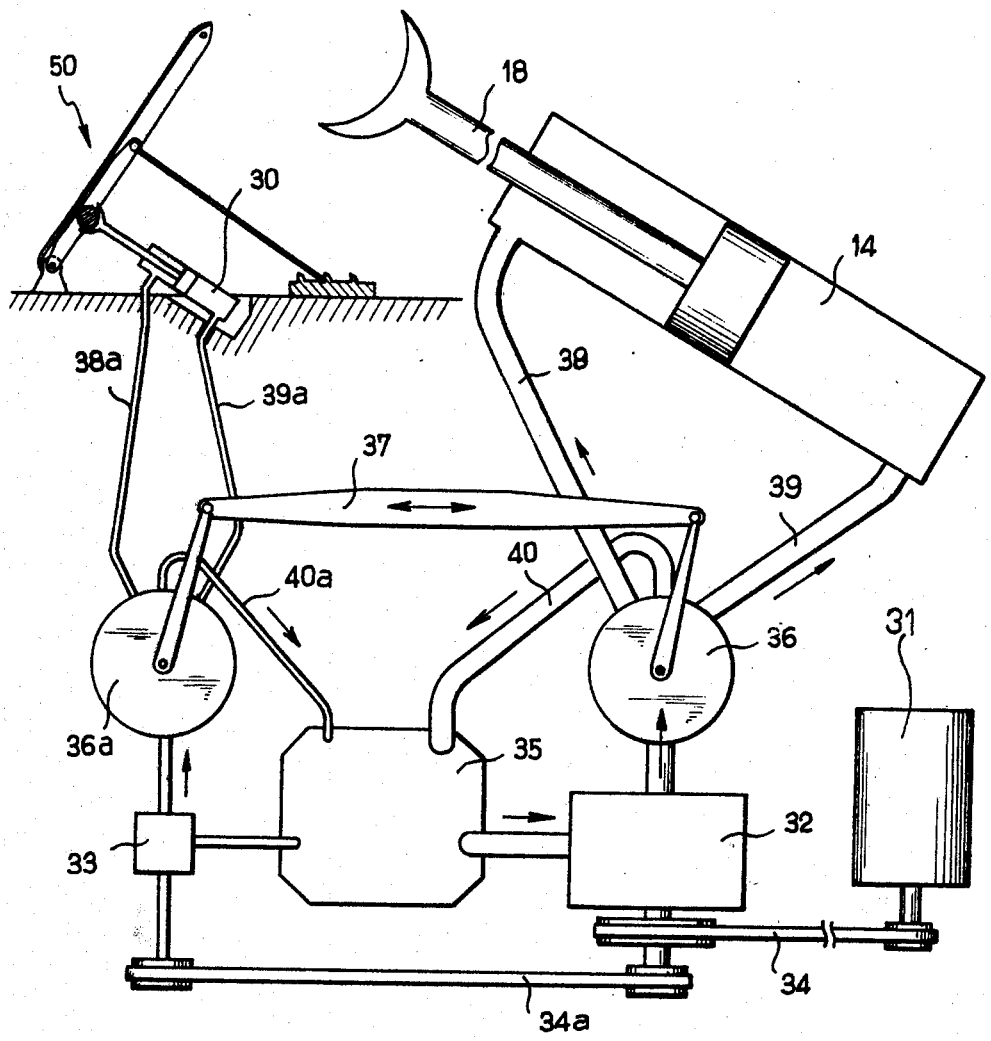

FIG. 7 illustrates one of the hydraulic devices which can be employed for achieving the synchronism under consideration.

In this figure, there has been adopted for the small-scale element 50 a linear scale of reduction of 1/5 with respect to the gate element, which corresponds to a division of the volumes of oil by 125.

Referring to FIG. 7, there is shown at 14 the jack which is associated with the element to be operated and which is obviously placed within the dam. The jack 30 of the small-scale element 50 is located on the contrary within the control station. The electric motor 31 actuates a large oil pump 32 by means of a notched driving belt 34 and a small pump 33 by means of a second driving belt 34*a*. In the case of the linear ratio of 1/5, the pump delivery is one hundred and twenty five times lower than that of the large pump 32.

The pumps 32, 33 feed distributors 36 and 36*a*, the control levers of which are coupled together by means of a bar 37. The distribution system is represented schematically by pipes 38, 38*a*, 39, 39*a*. By means of a set of valves controlled electrically by push-buttons, said distribution system supplies the upper compartment and the lower compartment of the jack 14 corresponding to any one of the wickets constituting the gate.

At the moment of start-up of the motor, the distributors 36, 36*a* are both in a position such that the oil returns to the reserve tank 35 via the pipes 40 and 40*a*.

The bar 37 which serves to couple the control units of the distributors 36 and 36*a* is displaced towards the right by means of a lever (not shown). The oil which is discharged flows either into the upper compartment of the two jacks or into the lower compartment. The displacements of the two jack-operating rods will therefore be homothetic and the same will apply to the element of the dam and of the model thereof, comprising the element 50 which is placed in full view of the technician. It is by observing the displacements of the foot of the prop within the slide on a small scale that the technician will carry out a displacement of the coupling bar 37 either to the right or to the left in order to produce upward or downward motion of the wickets.

This wicket control device is combined with the cup-sphere system and enhances its advantages of automatic operation by limiting to a maximum the action produced by the operator on the floor or body of the dam.

As will readily be understood, the invention is not limited to the examples described in the foregoing and many arrangements, modifications or improvements can accordingly be contemplated without thereby departing from the scope or the spirit of the invention.

From this it accordingly follows, for example, that the restoring means for placing the jack 14 in its extreme orientation can comprise a spring which produces action between the floor 1 or body of the dam on the one hand and the jack 14 on the other hand.

Provision can also be made for a wicket in which the horse 3 is dispensed with, in which case the wicket panel is pivoted directly to the body of the dam and adapted to carry the abutment member and prop which are pivotally attached thereto.

What is claimed is:

1. A gate system for a hydraulic dam comprising at least one wicket which can be set at a number of predetermined angles of inclination about a horizontal shaft which is attached to the floor or body of the dam, each wicket being provided with an operating device comprising on the one hand a jack pivotally mounted on the floor or body of the dam downstream of the wicket and on the other hand an abutment member rotatably mounted on a horizontal shaft carried by the wicket, said abutment member being intended to receive the free end of the operating rod of the jack, means being provided for ensuring that the operating rod of the jack is fully withdrawn into the jack body between two operations of said wicket, wherein the operating device comprises restoring means which tend to move the jack to an end angular orientation about its axis of pivotal motion, said end angular orientation being close to the different orientations assumed by the jack when the operating rod of said jack is in engagement with the abutment member in the different predetermined positions of inclination of the wicket, the end of the operating rod of the jack and the abutment member being provided with coupling means comprising a cup-like member and a convex member one of which is carried by the abutment member and the other by the end of the jack, the cup-like member being large enough to contact and receive therein the convex member in any of the predetermined inclinations of the wicket when the operating rod of the jack is being extended out of the jack body in the said end angular orientation of the jack.

2. A gate system according to claim 1, wherein the convex member is carried by the wicket and comprises a spherical zone traversed by said horizontal shaft, while the cup shaped member is fixed on the free end of the operating rod, wherein the dimensions of the cup are such that, in each of the aforesaid predetermined positions of the wicket, the center of the spherical zone of the abutment member is located within the interior of the cylinder swept by the cup when the jack is disposed in the aforesaid end angular orientation.

3. A gate system according to claim 2, wherein the direction of the jack in its end angular orientation is tangent to the circle described by the center of the spherical zone about the shaft of the wicket and wherein, in one of the predetermined positions of said wicket, the center of the spherical zone is located at the point at which the direction of extreme orientation of the jack is tangent to said circle described by the center of the spherical zone.

4. A gate system according to claim 1, wherein the restoring means aforesaid comprise the fact that the center of gravity of the jack remains located on the same side with respect to its axis of pivotal motion irrespective of the position of the operating rod of said jack.

5. A gate system according to claim 1 in which the jack body is placed within a housing formed in the floor or body of the dam, wherein the restoring means maintain the jack body applied against one wall of said housing in the end angular orientation of said jack.

6. A gate system according to claim 2, wherein the wicket is capable in addition of taking up a flat position in which the operating rod of the jack is fully withdrawn within the jack body when the spherical zone is in contact with the cup and in which the jack is maintained away from its end position of angular orientation under the action of the weight of the wicket.

7. A gate system according to claim 2, wherein the cup comprises a spherical bottom portion having a diameter which is substantially equal to the diameter of the spherical zone of the abutment member.

8. A gate system according to claim 7, wherein the spherical bottom portion aforesaid is extended at the periphery by a frusto-conical edge portion which is substantially tangent to said spherical bottom portion.

9. A gate system according to claim 1, wherein the horizontal rotary shaft carried by the wicket comprises a horizontal rod rigidly fixed to the spherical zone of the abutment member and rotatably mounted at both ends between two pivot-bearings of the wicket, said spherical zone being connected to said rod by means of two frusto-conical reinforcements.

10. A gate system according to claim 1, wherein the horizontal shaft which carries the abutment member is stationary and extends through an abutment component which is capable of rotating about the axis of said shaft and is provided with a spherical central zone.

11. A gate system according to claim 1, wherein said system further comprises a small-scale wicket installed within the visual range of an operator and means for imparting to said small-scale wicket a movement which is similar to that of one of the wickets of the gate.

12. A gate system for a hydraulic dam comprising at least one wicket which can be set at a number of predetermined angles of inclination about a horizontal shaft which is attached to the floor or body of the dam, each wicket being provided with an operating device comprising on the one hand a jack pivotally mounted on the floor or body of the dam downstream of the wicket and on the other hand an abutment member rotatably mounted on a horizontal shaft carried by the wicket, said abutment member being intended to receive the free end of the operating rod of the jack, the gate system further comprising means for ensuring that the operating rod of the jack is fully withdrawn into the jack body between two operations of said wicket, means for maintaining the jack directed substantially towards the abutment member during the periods of time separating the operations of the wicket, and coupling means for ensuring positive but detachable engagement of the end of the jack operating rod and of the abutment member when these components come into contact with each other, wherein these coupling means comprise a cup-like member fixed on the free end of the operating rod, and a substantially ball-shaped member traversed by the horizontal shaft carried by the wicket.

13. A gate system according to claim 12, wherein the operating device comprises restoring means which tend to move the jack to an end angular orientation about its axis of pivotal motion, said end angular orientation being close to the different orientations assumed by the jack when the operating rod of said jack is in engagement with the abutment member in the different predetermined positions of inclination of the wicket, the cup-like member being large enough to contact and receive therein the ball-shaped member in any of the predetermined inclinations of the wicket when the operating rod of the jack is being extended out of the jack body in the said end angular orientation of the jack.

14. A gate system according to claim 13, wherein the ball-shaped member comprises a spherical zone axially traversed by the horizontal shaft, while the dimensions of the cup are such that, in each of the aforesaid predetermined positions of the wicket, the center of the spherical zone of the abutment member is located within the interior of the cylinder swept by the cup when the jack is disposed in the aforesaid end position of angular orientation.

15. A gate system according to claim 13, wherein the direction of the jack in its end angular orientation is tangent to the circle described by the center of the spherical zone about the shaft of the wicket and wherein, in one of the predetermined positions of said wicket, the center of the spherical zone is located at the point at which the direction of extreme orientation of the jack is tangent to said circle described by the center of the spherical zone.

16. A gate system according to claim 13, wherein the restoring means aforesaid comprise the fact that the center of gravity of the jack remains located on the same side with respect to its axis of pivotal motion irrespective of the position of the operating rod of said jack.

17. A gate system according to claim 13 in which the jack body is placed within a housing formed in the floor or body of the dam, wherein the restoring means maintain the jack body applied against one wall of said housing in the end angular orientation of said jack.

18. A gate system according to claim 13 wherein the wicket is capable in addition of taking up a flat position in which the operating rod of the jack is fully withdrawn within the jack body when the ball-shaped member is in contact with the cup and in which the jack is moved away from its end angular orientation under the action of the weight of the wicket.

19. A gate system according to claim 14, wherein the cup comprises a spherical bottom portion having a diameter which is substantially equal to the diameter of the spherical zone of the abutment member.

20. A gate system according to claim 19, wherein the spherical bottom portion aforesaid is extended at the periphery by a frusto-conical edge portion which is substantially tangent to said spherical bottom portion.

21. A gate system according to claim 14, wherein the horizontal rotary shaft carried by the wicket comprises a horizontal rod rigidly fixed to the spherical zone of the abutment member and rotatably mounted at both ends between two pivot-bearings of the wicket, said spherical zone being connected to said rod by means of two frusto-conical reinforcements.

22. A gate system according to claim 12, wherein the horizontal shaft is stationary, while the ball-shaped member is capable of rotating about the axis of said shaft.

23. A gate system according to claim 13, wherein said system further comprises a small-scale wicket installed within the visual range of an operator and means for imparting to said small-scale wicket a movement which is similar to that of one of the wickets of the gate.

* * * * *